United States Patent [19]

Sasaki et al.

[11] Patent Number: 4,766,403

[45] Date of Patent: Aug. 23, 1988

[54] COPYING MACHINE HAVING MEANS TO ELIMINATE LOCAL TEMPERATURE CHANGES IN A PHOTORECEPTOR BELT

[75] Inventors: Hiromu Sasaki, Yamatokoriyama; Ikuo Itoh, Nara, both of Japan

[73] Assignee: Sharp Kabushiki Kaisha, Osaka, Japan

[21] Appl. No.: 886,254

[22] Filed: Jul. 16, 1986

[30] Foreign Application Priority Data

Jul. 16, 1985 [JP] Japan ..... 60-156269

[51] Int. Cl.[4] ..... G03G 15/00

[52] U.S. Cl. ..... 355/3 R; 355/3 BE

[58] Field of Search ..... 355/3 R, 3 FU, 3 BE, 355/14 R, 14 FU, 16

[56] References Cited

U.S. PATENT DOCUMENTS 4,212,631 7/1980 Franke et al. ..... 219/216 X
4,522,483 6/1985 Matsumoto et al. ..... 355/14 R X
4,647,177 3/1987 Yoshihito et al. ..... 355/3 BE

*Primary Examiner*—Arthur T. Grimley
*Assistant Examiner*—J. Pendegrass
*Attorney, Agent, or Firm*—Birch, Stewart, Kolasch & Birch

[57] ABSTRACT

A copying machine utilizing a generally endless photoreceptor belt trained between reduced and large diameter rolls. At least one of the rolls is drivingly coupled with a drive unit and is driven at a low speed when and so long as the machine is in a standby condition to avoid localized heating of the photoreceptor belt.

5 Claims, 2 Drawing Sheets

COPYING MACHINE HAVING MEANS TO ELIMINATE LOCAL TEMPERATURE CHANGES IN A PHOTORECEPTOR BELT

BACKGROUND OF THE INVENTION

1. Field of Technology

The present invention generally relates to an electrophotographic copying machine and, more particularly, to the copying machine utilizing a photoreceptor in the form of an endless belt. 2. Description of the Prior Art A copying machine utilizing a photoreceptor belt is well known. It is well known that this type of copying machine could be manufactured compact in size by disposing around and adjacent the photoreceptor belt all necessary processing units including a charger means, means for introducing imagewise light carrying an image of the original, a developer means, a transfer means and others. In addition, if one of the two support rolls over which the photoreceptor belt is trained is reduced in radius and a transfer charger is disposed in the vicinity of such one of the support rolls, not only can a powder image be transferred from the photoreceptor belt onto a copying paper, but also the copying paper can readily be separated naturally from the photoreceptor belt. The copying paper so separated with the powder image thereon is subsequently conveyed towards a fixing station. If these advantages peculiar to the photoreceptor belt are utilized, it is possible to shorten the belt length, to pack all of the necessary processing units in the vicinity of the photoreceptor belt, to reduce the radius of one of the support rolls and to dispose a fixing roll adjacent such one of the support rolls for facilitating the conveyance of the copying paper, separated from the photoreceptor belt, onto the fixing roll. In this way, the copying machine as a whole can be assembled in a compact size.

However, when the copying machine is assembled in a compact size in the manner described above, the surroundings of the fixing roll tend to be heated by heat generated from the fixing roll and will attain an elevated temperature when the copying machine itself is held in a standby, or READY, condition. Once this happens, the electroconductivity of the photoreceptor is adversely affected by a change in temperature to such an extent as to differentiate the surface potential at a dark area from that at a bright area, resulting in the possibility that the resultant copy would represent a reproduced image of varying image density.

In order to obviate the above discussed problem, it may be contemplated to arrange the fixing roll spaced a sufficient distance from the photoreceptor belt. However, this method does not contribute to reduction in size of the copying machine as a whole which ought to be achieved by the use of the photoreceptor belt.

SUMMARY OF THE INVENTION

Accordingly, the present invention has for its essential object to provide an improved copying machine wherein, even when the machine is held in standby condition, no local temperature change occurs in the photoreceptor belt, thereby making it possible to provide the resultant reproduced image having no varying image density.

In order to accomplish this object, the present invention provides an improved copying machine wherein, when and so long as the machine is held in standby condition, the photoreceptor belt is driven, and is kept driven, at a low speed to permit the entire photoreceptor belt to be uniformly heated by heat emanating from the fixing roll thereby to avoid any possible localized heating of the photoreceptor belt.

According to the present invention, even if the fixing roll is disposed in the close vicinity of one of the belt support rolls which is adjacent the transfer means, the temperature of the photoreceptor belt can be kept uniform over the entire surface thereof. Therefore, no variation in surface potential occurs in the photoreceptor belt, enabling the reproducing of an image with no varying image density. Moreover, because of the reduced distance between the fixing roll and such one of the support rolls, not only can the copying paper with the powder image transferred thereon be advantageously and smoothly conveyed onto the fixing roll after having been separated from the photoreceptor belt at a location adjacent such one of the support rolls, but also the copying machine itself can be manufactured in a compact size.

Since the speed at which the photoreceptor belt is driven during the standby condition of the copying machine is low, no substantial physical deterioration of the photoreceptor belt occurs even though the machine is kept held in the standby condition for a substantial length of time.

BRIEF DESCRIPTION OF THE DRAWINGS

This and other objects and features of the present invention will become clear from the following description taken in conjunction with preferred embodiments thereof with reference to the accompanying drawings, in which.

DETAILED DESCRIPTION OF THE EMBODIMENTS

Figure 1:
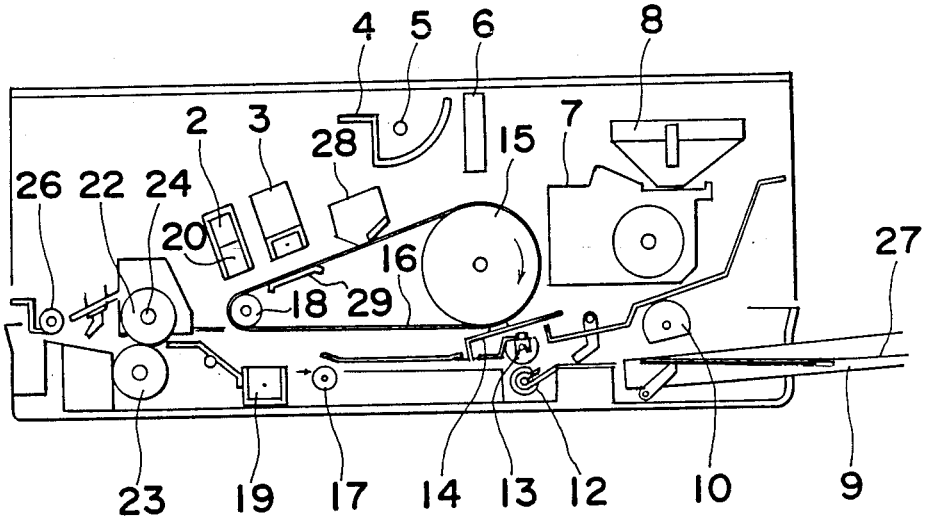
FIGS. 1 and 2 are schematic front sectional views of copying machines according to different embodiments of the present invention, respectively.

Before the description of the present invention proceeds, it is to be noted that like parts are designated by like reference numerals throughout the accompanying drawings.

An endless photoreceptor belt comprises a seamless base and an electroconductive layer deposited on an outer surface of the seamless base. The seamless base must have a high resistance to tension so that, when a tensile force acts on a local portion thereof, that portion of the seamless base will not remain dilated after the removal of the tensile force. Material for the seamless base may be polyimide (40 to 50 μm), and the electroconductive layer formed on the seamless base may be a layer (4 to 5 μm) formed by dispersing carbon particles into polyimide and has a resistance within the range of $10^4$ to $10^5$ ohm-cm. The seamless base having the electroconductive layer thereon also has a photosensitive layer formed over the electroconductive layer by coating bis-azo (or dis-azo) pigments (0.2 to 0.5 μm) and then coating a hydrazone derivative (10 to 15 μm) thereover, thereby completing the photoreceptor belt 16.

Referring now to FIG. 1 illustrating, in schematic front sectional representation, a copying machine according to one preferred embodiment of the present invention, the photoreceptor belt identified by 16 is trained between reduced and large diameter rolls 18 and 15 and is held taut. The reduced and large diameter rolls 18 and 15 are 20 mm and 40 mm in size, respectively. This photoreceptor belt 16 is electrostatically charged by a charger 3 so as to have a surface potential of −500V over the entire photosensitive surface. An optical system includes a light source 5 having a reflector shade 5, and a lens assembly 6 and is so operable that an image of the original placed on an original support 1 and illuminated by the light source 5 can be formed by the lens assembly 6 on the outer surface of the photoreceptor belt 16. In this way, the photoreceptor belt is exposed to the imagewise light to form an electrostatic latent image thereon.

The electrostatic latent image so formed on the photoreceptor belt 16 is subsequently developed into a powder image by a developing roll of a developer unit 16 while a bias voltage of −200V is applied. A developer contains carrier particles made of silicone coated iron particles dispersed and mixed with toner powder, in a quantity of 6%. Reference numeral 8 represents a hopper for receiving a mass of toner being replenished. Reference numeral 9 represents a paper supply tray accommodating a stack of copying papers 27, said copying papers 27 being fed one by one by a paper feed roll 10 and then by a pair of juxtaposed feed rolls 12 and 13 towards a PS plate 14. At the time at which the leading edge of the powder image on the photoreceptor belt with respect to the direction of run thereof coincides with the leading edge of the copying paper with respect to the direction of feed of the copying paper, the PS plate 14 is actuated to feed the copying paper onwards.

Subsequently, by the activation of a transfer charger 19, the powder image on the photoreceptor belt 16 is transferred onto the copying paper which is in turn fed through a pair of juxtaposed fixing rolls 22 and 23 where the powder image on the copying paper is fixed. It is to be noted that one of the fixing rolls, for example, the fixing roll 22 is heated by a heater lamp 24 to a predetermined temperature. It is also to be noted that, since the reduced diameter roll 18 has a small radius, the copying paper to be fed through the fixing rolls 22 and 23 can be separated from the photoreceptor belt 16 as the latter moves, without the necessity of using a special separating instrument.

The copying paper having passed through the fixing rolls 22 and 23 is discharged by an ejecting roll 26 to the outside of the machine, for example, a receiving tray (not shown). On the other hand, the residue of toner remaining on the photoreceptor drum without being transferred onto the copying paper is scraped off from the photoreceptor belt by a blade of a cleaning unit 26 and is then collected into a recovery box (not shown). The electrostatic charge on the photoreceptor belt 16 is erased by an erasing charger 20 and an erasing lamp 2 in readiness for the next cycle of copying operation.

In order to avoid any possible fluttering motion of the photoreceptor belt during the passage thereof past the charging station, the developing station and the cleaning station, a back-up plate 29 is arranged inside the photoreceptor belt 16 to support it from behind as shown. By so doing, the photoreceptor belt can be kept uniformly spaced a predetermined distance from any one of the various processing units, such that a factor which would result in any possible deviation in characteristic of each of the processing units can be removed.

Figure 2:
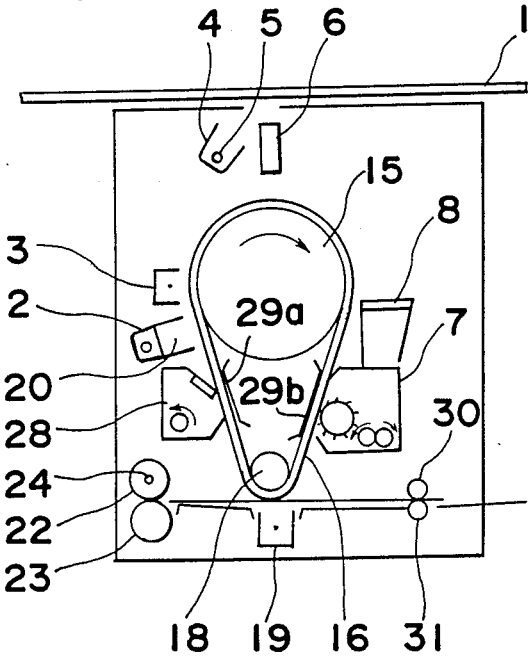

In the embodiment shown in FIG. 2, as the drawing makes it clear, the reduced and large diameter rolls 18 and 15 are positioned one above the other adjacent the transfer charger 19 and the original support 1, respectively. Because of this unique positioning of the rolls 18 and 15 around which the photoreceptor belt 16 is trained, the width of the copying machine as a whole could be advantageously reduced. Reference numerals 30 and 31 represent feed rolls 30 and 31 juxtaposed to each other, and since they contribute to the reduction in distance to the fixing rolls 22 and 23, not only can the possibility of occurrence of paper jam in the paper conveying passage be minimized, but the copying paper, if jammed, can be removed easily. In this embodiment, two back-up plates **29*a* and 29*b*, each functioning in a manner similar to the back-up plate 29 used in the foregoing embodiment, are employed, the back-up plate 29*a* being positioned on one side of the belt 16 opposite to the cleaning unit 28 and the back-up plate 29*b* on one side of the belt 16 opposite to the developing unit 7**.

Figure 3:
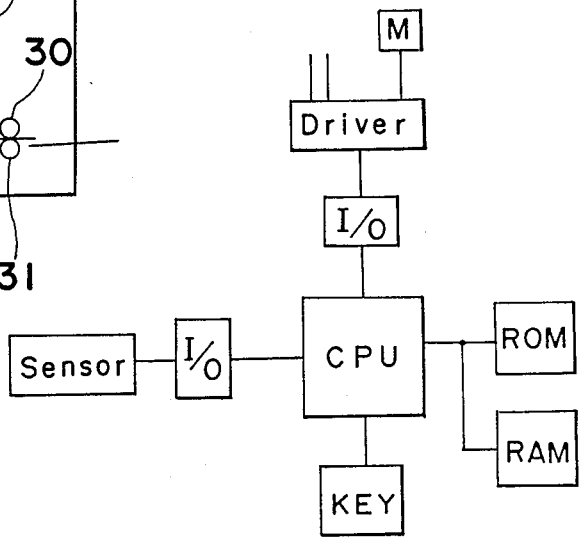
FIG. 3 is a circuit block diagram showing a control unit used in the present invention.

FIG. 3 illustrates a control unit in the form of a block circuit diagram. A central processing unit CPU is comprised of a microprocessor operable to execute processes according to a control program stored in a read-only memory ROM. This central processing unit CPU determines the state of an input made to a keyboard input device KEY and executes a process specified by a particular key actually manipulated. A driver is a control circuit for controlling a motor M and other drive devices and controls a drive circuit in response to an output signal fed thereto from the central processing unit CPU through an input/output control I/O. A sensor is operable to detect the arrival of the copying paper at a predetermined position or the arrival of the original support at a predetermined position, the state thereof being subsequently determined by the central processing unit CPU through the input/output control I/O. A random access memory RAM is used as a working area at the time of execution of the control program stored in the read-only memory ROM.

Figure 4:
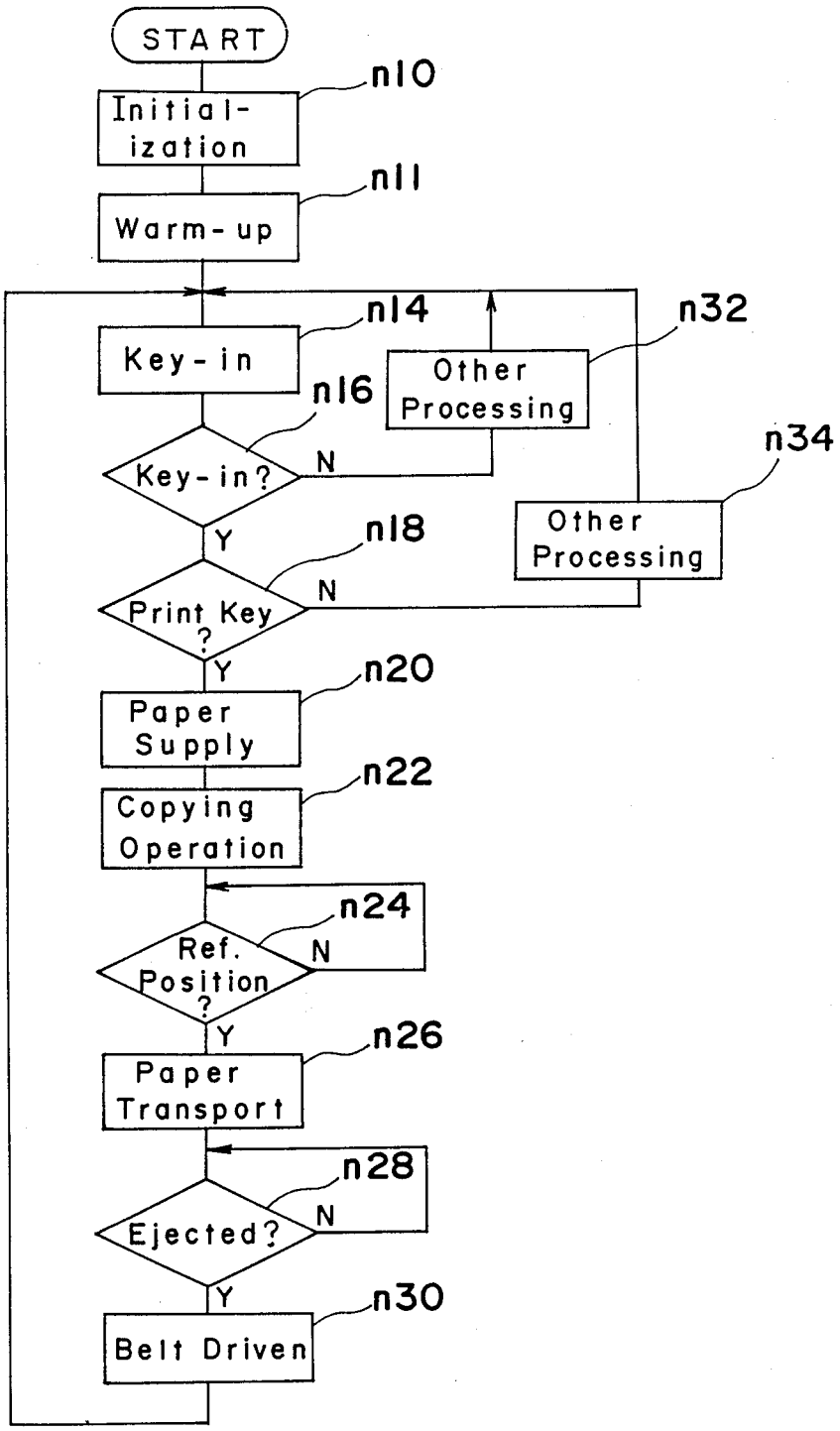
FIG. 4 is a flow-chart showing the sequence of operation of a central processing unit for controlling the control unit.

FIG. 4 illustrates a flowchart showing the sequence of operation performed by the central processing unit CPU. At step n10, various machine components of the copying machine are initialized. At step 11, the fixing rolls 22 and 23 are warmed up and, on this occasion, the large diameter roll 15 is driven at a low speed. When the heater roll including fixing roll 22 and heater lamp 24 attains a predetermined temperature, the state of a keyed-in input is read in at step n14. Some key is keyed in, and if it is a Print key, the supply of the copying paper is initiated at step n20. In the case of the copying machine shown in FIG. 1, the feed roll 10 is driven to feed the uppermost copying paper, in the stack of papers accommodated in the paper tray, until it abuts against the PS plate 14. At step n22, a copying operation is performed according to a predetermined sequence and, during this copying operation the large diameter roll 15 is driven at a speed corresponding to the speed of scan of the original support. At step 24, a decision is made to determine if the original support then scanning has arrived at a reference position. If the original support has arrived at the reference position, the program flow proceeds to step n26 at which the PS plate 14 is activated to start the transportation of the copying paper. As the copying paper is moved past the transfer station, a powder image formed on the photoreceptor belt is transferred onto the copying paper, which paper is in turn ejected after the powder image on the copying paper has been fixed by the fixing rolls 22 and 23. Thereafter, at step n28, a decision is made to determine if the copying paper with the powder image fixed has been ejected. If it has been ejected, the photoreceptor belt is then driven at a low speed at step n30, bringing the copying machine in a standby condition. Thus, the copying machine is brought in the standby condition subsequent to the warm-up and also subsequent to the completion of the copying operation, and during the condition in which the copying machine is held in the standby condition, the large diameter roll is driven at a low speed to drive the photoreceptor drum at a correspondingly low speed. Because of this, heat emanating from the heater roll acts to heat the photoreceptor belt uniformly, thereby preventing local portions of the photoreceptor belt from being excessively heated to such an extent as to result in variation of the surface potential. The control of the speed of drive of the photoreceptor belt can be accomplished by causing the driver, shown in FIG. 3, to control the motor M in dependence on the output signal from the central processing unit CPU.

It is to be noted that step n32 represents other processes performed when no input is keyed in, and step n34 represents the step wherein, when a key other than the Print key has been depressed, a process appropriate to such key is carried out.

Although the present invention has been described in connection with the preferred embodiments thereof, it is to be noted that various changes and modifications are apparent to those skilled in the art. By way of example, although reference has been made to the use of the endless or seamless photoreceptor belt, a photoreceptor belt having its opposite ends connected together or formed into a loop can be equally applicable.

What is claimed is:

1. A copying machine comprising:

an original scanning means for scanning an original to be copied;

a paper transport means for transporting a copying paper from a supply station towards an ejecting station;

first and second rollers;

a photoreceptor belt trained between said first and second rollers;

means for driving at least one of said first and second rollers in a predetermined direction;

a charging device;

an imagewise light introducing device;

a developer and transfer unit, said charging device, developer and transfer unit being disposed in the vicinity of said photoreceptor belt;

fixing means for heat fixing a powder image transferred from the photoreceptor belt onto the copying paper, wherein said fixing means is disposed in the vicinity of one of the first and second rollers which is located adjacent said transfer unit; and means for avoiding localized heating of said photoreceptor belt by said fixing means, said means for avoiding including said means for driving wherein said means for driving drives at least one of said first and second rollers at a low speed when the copying machine is in a condition other than a copying operation.

2. A copying machine comprising:

first and second rollers;

an endless photoreceptor belt trained between said first and second rollers in a predetermined direction;

fixing means disposed adjacent a predetermined portion of said endless photoreceptor belt for heat fixing a powder image transferred from said endless photoreceptor belt onto a copying paper, wherein said fixing means is disposed adjacent one of said first and second rollers; and means for avoiding localized heating of said photoreceptor belt by said fixing means, whereby said means for driving drives at least one of said first and second rollers at a low speed when said copying machine is in a mode other than a copying mode.

3. The copying machine according to claim 2, wherein said fixing means includes a fixing roller and a heater lamp.

4. The copying machine according to claim 2, wherein said low speed is less than a copying operation speed and occurs both subsequent to a warm-up of said copying machine and subsequent to completion of a copying operation.

5. A copying machine comprising:

an original scanning means for scanning an original to be copied;

a paper transport means for transporting a copy paper from a supply station towards a discharge station;

first and second rollers;

a photoreceptor belt trained between said first and second rollers;

a charging device;

an imagewise light introducing device;

a developer and transfer unit, said charging device, developer and transfer unit being disposed in the vicinity of said photoreceptor belt;

fixing means for heat fixing a powder image transferred from the photoreceptor belt onto the copying paper, wherein said fixing means is disposed in the vicinity of one of the first and second rollers which is located adjacent said transfer unit;

means for detecting, and generating a signal indicative of, the completion of discharge of the copying paper at said discharge station; and belt drive control means for generating, in response to the signal from said means for detecting, a signal necessitated to drive the photoreceptor belt at a low speed;

wherein said means for driving drives at least one of said first and second rollers at a low speed when the copying machine is in a condition other than a copying operation to avoid localized heating of said photoreceptor belt by said fixing means.

* * * * *